US005720065A

United States Patent [19]

Myers et al.

[11] Patent Number: 5,720,065

[45] Date of Patent: Feb. 24, 1998

[54] DIRECT DRIVE DISCRIMINATOR MECHANISM

[75] Inventors: Sean F. Myers, Webster City, Iowa; Jack W. Bailey, West Fargo, N. Dak.

[73] Assignee: White Consolidated Industries, Inc., Cleveland, Ohio

[21] Appl. No.: 712,155

[22] Filed: Sep. 11, 1996

[51] Int. Cl.[6] ..... D06F 37/40

[52] U.S. Cl. ..... 8/159; 68/12.02; 68/12.14; 68/23.7

[58] Field of Search ..... 8/159; 68/23.7, 68/12.01, 12.02, 12.14, 12.16, 12.24

[56] References Cited

U.S. PATENT DOCUMENTS

| | | | |
|---|---|---|---|
| 1,886,888 | 11/1932 | Kirby | 68/23.7 X |
| 4,542,633 | 9/1985 | Hirooka et al. . | |
| 4,563,786 | 1/1986 | Brunswick et al. . | |
| 4,676,077 | 6/1987 | Hirooka et al. . | |
| 4,853,605 | 8/1989 | Matsuo et al. . | |
| 4,916,439 | 4/1990 | Estes et al. . | |
| 5,070,565 | 12/1991 | Sood et al. . | |
| 5,076,076 | 12/1991 | Payne . | |

*Primary Examiner*—Philip R. Coe

*Attorney, Agent, or Firm*—Pearne, Gordon, McCoy & Granger LLP

[57] ABSTRACT

A direct-drive washing machine has a drive system adapted for spinning a spin tub during a spin cycle and oscillating an agitator within the spin tub during an agitation cycle. The drive system includes a mounting plate secured to a splash tub, an electric motor supported by the mounting plate, and a drive shaft directly connecting the motor and the agitator. A drive hub encircles the drive shaft and is rotatable relative to the drive shaft. The drive hub is rigidly connected to the spin tub and has a strike plate downwardly extending from a bottom surface of the drive hub. A drive pin is rigidly connected to the drive shaft below the drive hub and engages the strike plate upon continuous rotation of the drive shaft to spin the spin tub and allows oscillation of the agitator upon oscillation of the drive shaft. A locking device selectively engages the drive hub to prevent rotation of the drive hub, and the spin tub attached thereto, during oscillation of the agitator. A sensing device detects a location of the drive pin to avoid contact between the drive pin and the strike plate when the locking device is engaging the drive hub.

26 Claims, 9 Drawing Sheets

DIRECT DRIVE DISCRIMINATOR MECHANISM

BACKGROUND OF THE INVENTION

1. Field of the Invention

The present invention pertains to a domestic washing machine and, more particularly, to a discriminator mechanism which both agitates and spins appropriate members of a direct drive washing machine.

2. Description of Related Art

Automatic washing machines typically hold clothing or other fabric articles in a perforate basket, immerse the clothing in water, and wash the clothing under the influence of an oscillating agitator. After washing, the clothing is rinsed with water and the basket is rotated at a high speed to centrifugally extract the rinse water from the clothing and the basket. Typically, a mechanical transmission and/or clutch produces the oscillatory motion of the agitator upon rotation of a drive motor in one direction and produces the continuous rotation the basket upon rotation of the drive motor in the other direction.

The transmission and clutch systems, however, are relatively complex and expensive. Additionally, the spin speed of the basket has a relatively low limit and the agitator has a fixed stroke angle. Furthermore, a braking device is required to stop the basket from spinning. Accordingly, there is a need in the art for a washing machine which eliminates the need for a transmission, a clutch, and a braking device, has a variable stroke angle for the agitator, is relatively simple in design, and is cost effective to produce.

SUMMARY OF THE INVENTION

The present invention provides an improved washing machine which overcomes at least some of the above-noted problems of the prior art. The washing machine includes a splash tub, a spin tub located within the splash tub, an agitator located within the spin tub, and a direct drive system adapted for spinning the spin tub during a spin cycle and oscillating the agitator during an agitation cycle. The direct drive system includes an electric motor and a drive shaft having a first end connected to the motor and a second end connected to the agitator. A drive pin is rigidly connected to the drive shaft. A drive hub encircles the drive shaft and is rotatable relative to the drive shaft. The drive hub is rigidly connected to the spin tub and has a strike plate which is engaged by the drive pin upon continuous rotation of the drive shaft to rotate the spin tub. The strike plate is formed to allow oscillation of the drive pin upon oscillation of the drive shaft to oscillate the agitator. A locking device selectively prevents rotation of the drive hub, and the spin tub attached thereto, during oscillation of the agitator.

In a preferred embodiment, the direct drive system includes a sensing device which detects the location of the drive pin to avoid contact between the drive pin and the strike plate when the locking device is engaged. If the drive pin contacts the strike plate when the locking device is engaged, the drive system can lockup or the drive pin can break off the drive shaft. The sensing device can include a motor controller and a washer controller in electrical communication with the motor controller to detect when the drive pin contacts the strike plate. The motor controller can determine a current, a speed error level, or a torque error level of the motor which is compared by the washer controller to a predetermined value which indicates contact between the drive pin and the strike plate. Preferably, the washer controller adjusts a stroke angle of the drive pin when contact between the drive pin and the strike plate is detected to avoid contact during a subsequent stroke. The sensing device can alternatively include a pair of sensors positioned at opposite ends of the oscillation of the drive pin to detect when the drive pin is about to contact the strike plate so that rotation of the drive pin can be reversed before the drive pin contacts the strike plate. The sensors are preferably hall effect transducers or photo detectors.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
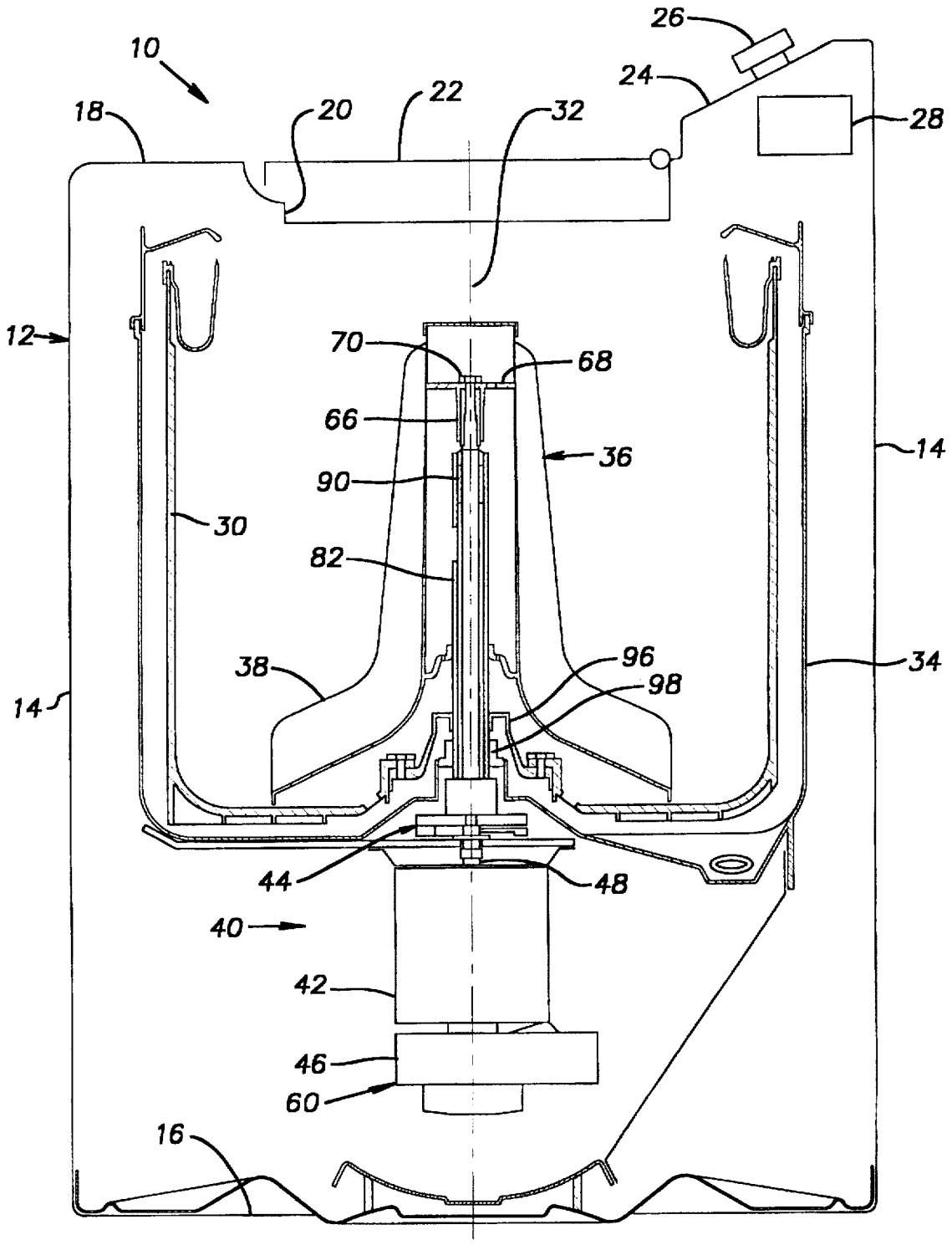
FIG. 1 is a schematic elevational view of a washing machine according to the present invention.

FIG. 1 schematically illustrates a clothes washing machine 10 according to the present invention. The washing machine 10 includes a boxlike cabinet 12 formed of a plurality of sheet metal panels which form four vertically extending sidewalls 14 (only two shown), a bottom or base wall 16, and a top wall 18. The top wall 18 is provided with an access opening 20 and a pivotally mounted door 22 for selectively closing and opening the access opening 20. Clothes or other articles to be cleansed are loaded and unloaded through the access opening 20 into the interior of the cabinet 12. A control console 24 is provided at the rear of the top wall 18 which includes a control knob 26 or other suitable control device which allows a user to select one of several predetermined sequences of cycles for the washing machine 10. A microprocessor or controller 28 controls the selected sequence of cycles.

The articles are loaded through the access opening 20 into a perforated inner tub or spin tub 30 which rotates about a vertical spin axis 32 to centrifugally extract wash fluids from the articles during a spin cycle. The spin tub 30 is surrounded by an imperforate outer tub or splash tub 34 to contain the wash and rinse water. An agitator 36 is located within the spin tub 30 and has a series of upstanding vanes 38 formed thereon. The agitator 36 oscillates about the spin axis 32 to agitate or scrub the articles to be cleansed during, for example, wash and rinse cycles.

Once the articles are loaded into the spin tub 30, the operator initiates the desired operating cycle. Typically, the operating cycle includes filling the splash tub 34 with wash water, oscillating the agitator 36 so that the vanes 38 engage and mix the articles and wash water contained within the spin tub 30, draining wash fluid from the splash tub 34, filling and draining the splash tub 34 one or more times with rinse water, and spinning the spin tub 30 to centrifugally extract water from the articles therein. It is submitted that the foregoing generally describes a rather well-known or conventional washing machine assembly, and is provided herein only to clarify the environment in which the present invention, to be described hereafter, is employed.

A direct drive system 40 which both oscillates the agitator 36 and rotates the spin tub 30 includes an electric motor 42 and a discriminator mechanism 44. The electric motor 42 is preferably a DC motor such as, for example, a switched reluctance universal motor, an electrically commutated motor (ECM), or a permanent magnet motor, which is operated by a controller 46. The motor controller 46 is suitably connected to the washing machine controller 28 to provide electrical communication therebetween.

The motor 42 has a vertical axis output shaft 48 coaxial with the spin axis 32 the washing machine 10 and directly connected to the discriminator mechanism 44. The motor 42 of the illustrated embodiment is mounted to the bottom of the discriminator mechanism 44. Alternatively, the output shaft 48 of the motor 42 can be offset from the spin axis 32 of the washing machine 10 and connected to the discriminator assembly 44 with a suitable drive belt and pulleys.

The discriminator mechanism 44 has two alternative modes of operation depending on rotation of the motor output shaft 48. In a first or agitation mode, the discriminator mechanism 44 operates to oscillate the agitator 36 within the spin tub 30 in response to oscillating motion, that is back-and-forth rotating motion, of the motor output shaft 46. In a second or spin mode, the discriminator mechanism 44 operates to rotate the spin tub 30 within the splash tub 34 in response to spinning motion, that is continuously rotating motion, of the motor output shaft 46.

Figure 2:
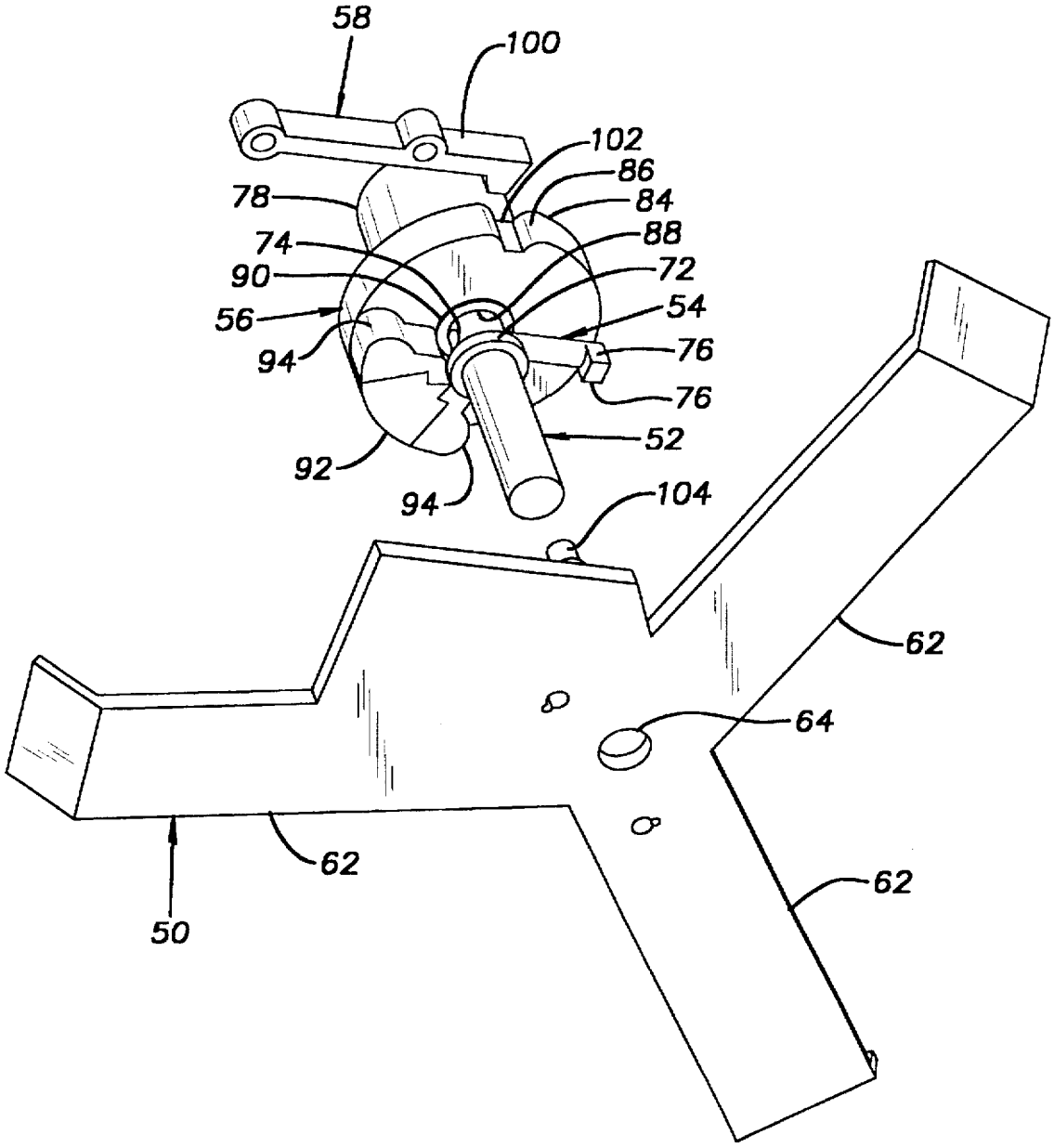
FIG. 2 is an enlarged, partially exploded, bottom prospective view, of a discriminator mechanism of the washing machine of FIG. 1.
Figure 3:
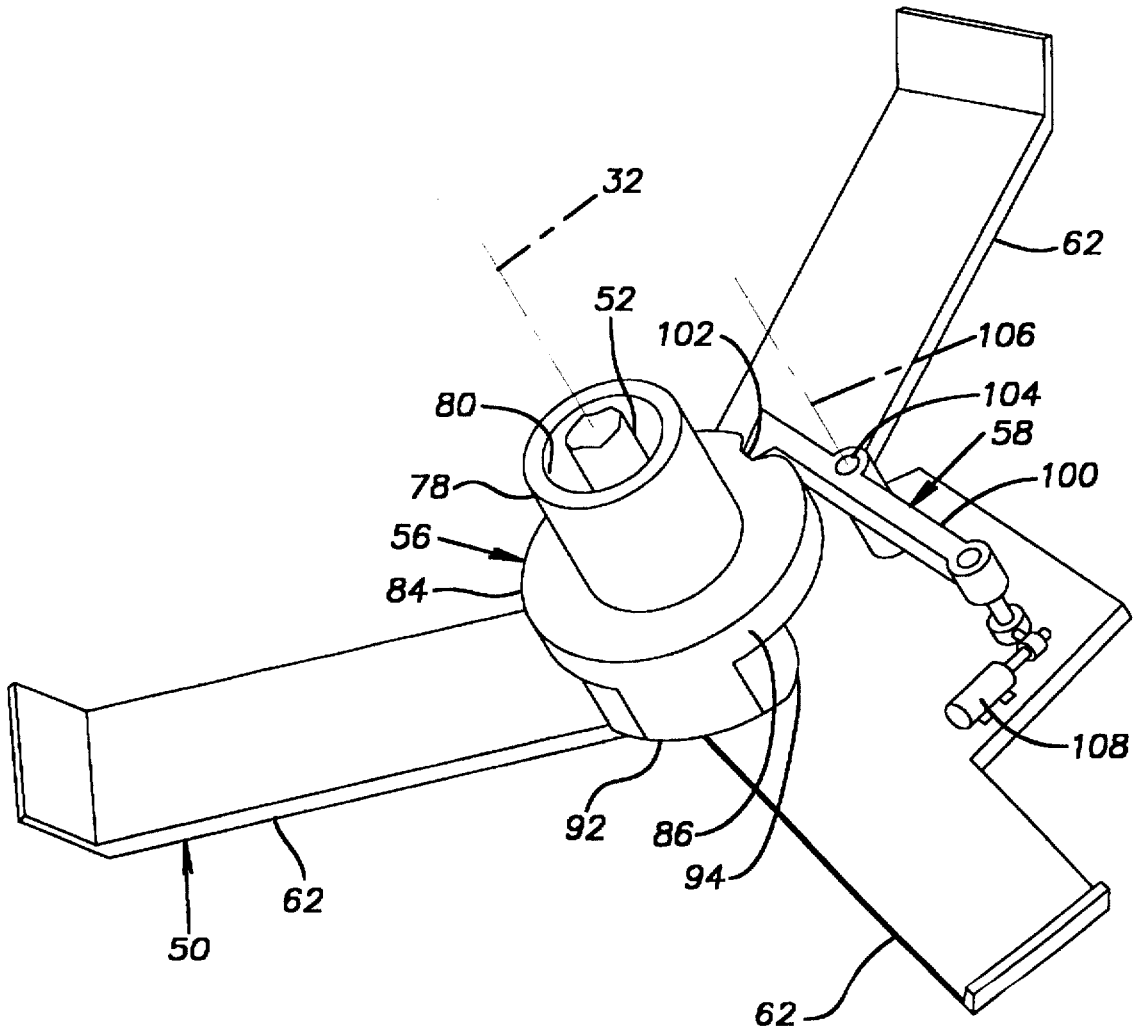
FIG. 3 is an enlarged top prospective view, of a discriminator mechanism of the washing machine of FIG. 1.

As best shown in FIGS. 1, 2, and 3, the discriminator mechanism 44 includes a mounting plate 50, a drive shaft 52, a drive pin 54, a drive hub 56, a locking device 58, and a sensing device 60 which detects the location of the drive pin 54. The mounting plate 50 is generally planar and has three equally spaced legs 62 which outwardly extend. The mounting plate is appropriately secured to the splash tub 34. The legs 62 are sized for extending across the bottom of the splash tub 34 and have upturned ends located at the sides of the splash tub 34. The center of the mounting plate 50 is located at the spin axis 32 and is provided with a clearance hole or opening 64 for the drive shaft 52.

The drive shaft 52 has a first or lower end which extends downwardly through the opening 64 in the mounting plate 50 and is directly attached to the output shaft 48 of the motor 42. The drive shaft 52 has a second or upper end which is directly attached to the agitator 36. The agitator 36 has a cylindrically-shaped sleeve 66 which is coaxial with the drive shaft 52 and projects downwardly from a partition wall 68. The drive shaft 52 has a spline-connection with the sleeve 66 of the agitator 36 so that the agitator 36 is rigidly attached to the drive shaft 52 and rotates with the drive shaft 52. A threaded bolt 70 extends through the wall 68 of the agitator 36 and into a threaded hole in the upper end of the drive shaft 52 to secure the agitator 36 to the drive shaft 52 and prevent relative axial movement between the agitator 36 and the drive shaft 52. Suitable bearings 72 are provided so that the drive shaft 52, and the agitator 36 attached thereto, rotate relative to the mounting plate 50 and the splash tub 34 in response to rotation of the output shaft 48 of the motor 42.

The drive pin 54 is attached to the drive shaft 52 below the drive hub 56. The illustrated drive pin 54 has a generally cylindrically-shaped first or inner end which extends into an opening 74 in the drive shaft 52 substantially perpendicular to the longitudinal axis of the drive shaft 52. The drive pin 54 also has a second or outer end which forms a pair of opposed engagement surfaces 76 at sides of the drive pin 54 and extend downwardly from a shaft portion of the drive pin 54. The engagement surfaces 76 are preferably planar and parallel and are spaced radially outward from the spin axis 32.

The drive hub 56 includes a generally cylindrical mounting portion 78 having a central passage 80 longitudinally extending therein. The central passage 80 has a diameter sized for receiving a first or lower end of a spin tube 82 with an interference or press fit so that the spin tube 82 is rigidly attached to the drive hub 56 and rotates with the drive hub 56. The mounting portion 78 upwardly extends from the top side of a generally planar drive plate 84 having a generally circular outer peripheral surface 86. The drive plate 84 is provided with a central opening 88 sized for the drive shaft 52 to pass therethrough. The drive shaft 52 upwardly extends through the central opening 88 in the drive plate 84 and through the spin tube 80 to the agitator 36. Suitable bearings 90 are provided so that the drive hub 56, and the spin tube 82 and spin tub 30 attached thereto, are rotatable relative to the drive shaft 52.

A strike plate 92 downwardly extends from the bottom surface of the drive plate 84 and is axially aligned with the drive pin 54. The strike plate 92 forms a pair of opposed engagement surfaces 94 shaped and located for engagement with the engagement surfaces 76 of the drive pin 54. The strike plate 94 is located over a limited portion of the circumference of the drive plate 84 so that the drive shaft 52 can oscillate over a limited stroke angle without the drive pin 54 engaging the strike plate 92. Preferably, the strike plate 92 extends for less than about 150 degrees so that the drive shaft 52 can oscillate over about 210 degrees.

The spin tube 80 extends upwardly through bottom openings in the splash tub 34 and spin tub 30. An attachment member 96 is secured to the bottom wall of the spin tub 30 and the spin tube 82 so that the spin tub 30 is rigidly secured to the spin tube 82 and rotates with the spin tube 82. A seal member 98 is provided between the splash tub 34 and the spin tube 82 to prevent wash liquid within the splash tub 34 from flowing or leaking out of the splash tub 34.

During the spin mode, the motor 42 is controlled to spin the drive shaft 52, and drive pin 54 attached thereto, continuously in one direction. One of the engagement surfaces 76 of the drive pin 54 contacts one of the engagement surfaces 94 of the strike plate 92 which causes the drive hub 56, and the spin tube 82 and the spin tub 32 attached thereto, to rotate. To stop rotation of the spin tub 30, the controller 46 slows down rotation of the motor output shaft 48 and the drive shaft 52 attached thereto. Momentum causes the drive hub 56 to continue rotating at relatively the same speed until the other one of the engagement surfaces 76 of the drive pin 54 contacts the other one of the engagement surfaces 94 of the strike plate 92 so that the motor 42 can brake the drive hub 56, and spin tube 82 and spin tub 30 attached thereto, to a stop. During an agitation mode, the motor 42 is controlled to oscillate the drive shaft 52, and the agitator 36 attached thereto, over a limited arc or angle. The locking device 58 locks the drive hub 56 to the mounting plate 50 so that the drive hub 56, and spin tube 82 and spin tub 30 attached thereto, do not rotate while the drive shaft 52 and the agitator 36 are oscillated.

The locking device 58 includes a locking fork 100 with a cooperating notch 102. The locking fork 100 has a first or locking end adjacent the peripheral surface 86 of the drive hub drive plate 84 and a second or actuating end opposite the first end. The locking end of the locking fork 100 is shaped to cooperate with the notch 102 which is located in the peripheral surface 86 of the drive plate 84 to lock the drive hub 56 to the mounting plate 50, that is, to prevent the drive hub 56 from rotating. Preferably, the locking end of the locking fork 100 is generally trapezoidal-shaped and the notch 102 has angled side surfaces each with a rounded outer end (as best shown in FIG. 2) so that the locking fork 100 and the notch 102 are self-aligning.

The locking fork 100 is pivotally attached to a pivot pin 104 located between the first and second ends of the locking fork 100 on the top surface of the mounting plate 50. Attached in such a manner, the locking fork 100 is pivotable on an axis of rotation 106 substantially perpendicular to the spin axis 32 of the washing machine 100. The locking fork 100 is pivotable between a locking position (best shown in FIG. 3) wherein the first end of the locking fork 100 engages the notch 102 of the drive plate 84 to substantially prevent relative rotation between the drive hub 56 and the stationary mounting plate 50 and an unlocked position (not shown) wherein the first end of the locking fork 100 is out of engagement with the notch 104 of the drive plate 84 to allow relative rotation between the drive hub 56 and the mounting plate 50.

An actuator 108 is mounted to the top surface of the mounting plate 50 and is suitably attached to the second end of the locking fork 100 to selectively move the locking fork 100 between the locking and unlocked positions. The illustrated actuator 108 is a linear actuator with appropriately linked to the locking fork 100. It is noted, however, that other types of actuators can be utilized within the scope of the present invention.

During the agitation mode when the locking device 58 is engaged, unintentional contact between the drive pin 54 and the strike plate 92 can cause the drive system 40 to lockup which can damage the drive system 40 or the drive pin 54 can be broken off. The sensor 60 determines when the drive pin 54 has engaged or come close to engaging the strike plate 92 so that oscillation of the agitator 36 can be adjusted to avoid unintentional contact and possible lockup of the drive system 40.

Figure 4:
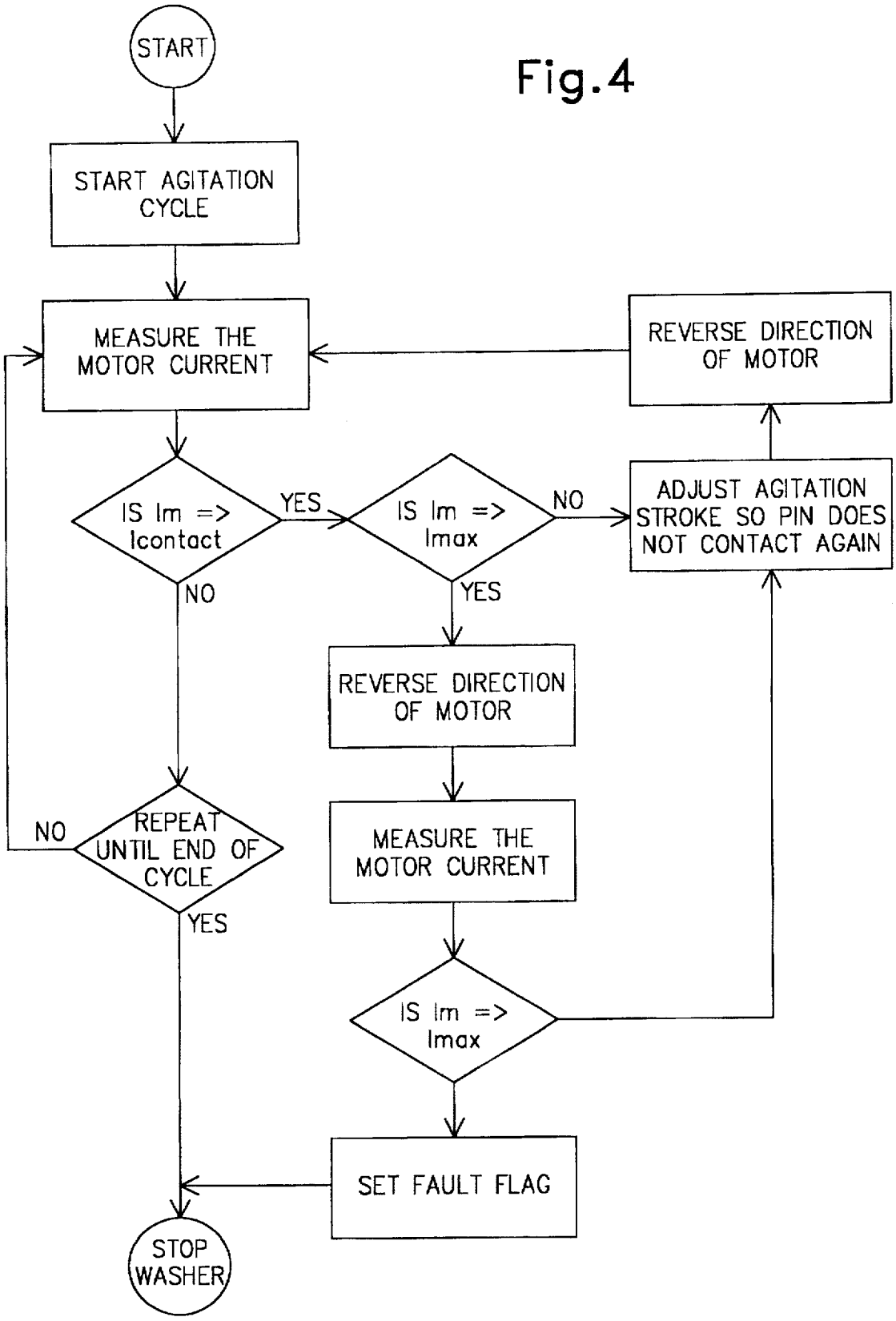
FIG. 4 is a flow diagram of a control algorithm for a sensing device of the discriminator mechanism of FIG. 3 using motor current.

The sensing device 60 includes the motor controller 46 which detects when the drive pin 54 has come into contact with the strike plate 92 by using either the load current of the motor 42, the speed error level of the motor 42, or the torque error level of the motor 42. As best shown in FIG. 4, when the load current of the motor 42 is used to detect contact, the motor controller 46 monitors the current ($I_m$) of the motor 42, and compares the motor current ($I_m$) with a predetermined value ($I_{contact}$) which is near the stall current of the motor 42 and indicates that contact has occurred. When the controller 46 senses a motor stall condition and the motor current ($I_m$) is not greater than a maximum current ($I_{max}$) of the motor 42, the oscillation arc or angle of the agitator 36 is adjusted so that the drive pin 54 does not contact the strike plate 92 on the next stroke and the direction of the motor 42 is reversed. When the controller 46 senses a motor stall condition and the motor current ($I_m$) is greater than a maximum current ($I_{max}$) of the motor 42, the direction of the motor 42 is reversed and the motor current ($I_m$) is again compared to the motor maximum current ($I_{max}$). If the motor current ($I_m$) is no longer greater than the motor maximum current ($I_{max}$), the oscillation arc of the agitator 36 is adjusted so that the drive pin 54 does not contact the strike plate 92 on the next stroke and the direction of the motor 42 is reversed. A lockup condition is indicated and the washing machine 10 is stopped, however, if the motor current ($I_m$) remains greater than the motor maximum current ($I_{max}$). From the above description it can be seen that the agitator 36 has a continuously variable stroke angle.

Figure 5:
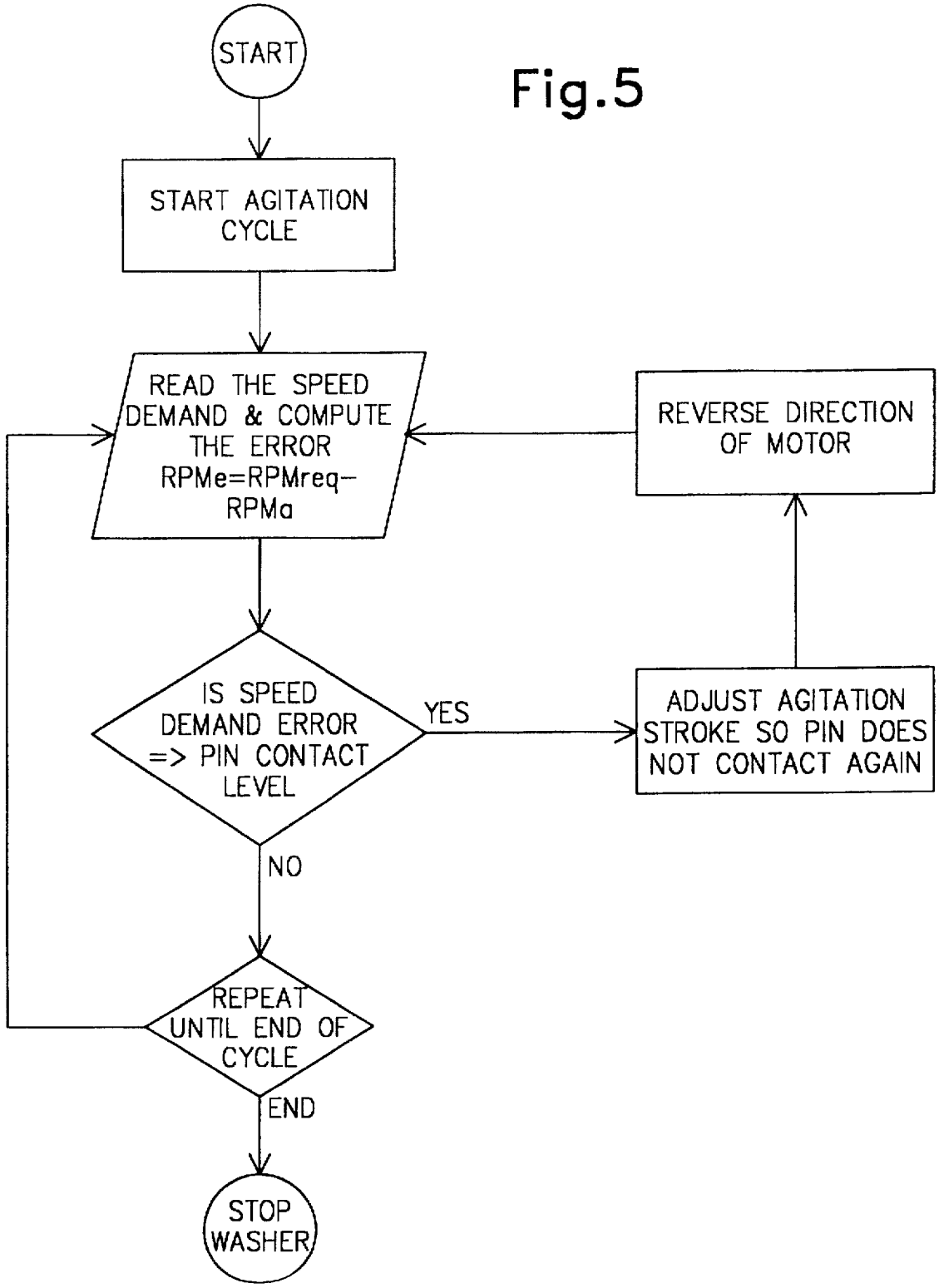
FIG. 5 is a flow diagram of a control algorithm for a sensing device of the discriminator mechanism of FIG. 3 using motor speed error level.

As best shown in FIG. 5, when the speed error level ($RPM_{req}$) of the motor 42 is used to detect contact, the motor controller 46 monitors the requested speed ($RPM_{req}$) and the actual speed ($RPM_a$). The controller 46 calculates the speed demand error level which is the difference between the requested speed ($RPM_{req}$) and the actual speed ($RPM_a$). The motor controller 46 sends the error level ($RPM_e$) to the washer controller 28. The washer controller 28 compares the error level ($RPM_e$) with a predetermined value (Pin Contact Level) which indicates that contact of the drive pin 54 has occurred. When the washer controller 28 determines that the error level ($RPM_e$) is greater than the predetermined value, the washer controller 28 sends a signal to the motor controller 46 to adjust the oscillation arc of the agitator 36 so that the drive pin 54 does not contact the strike plate 92 on the next stroke and to reverse the direction of the motor 42.

Figure 6:
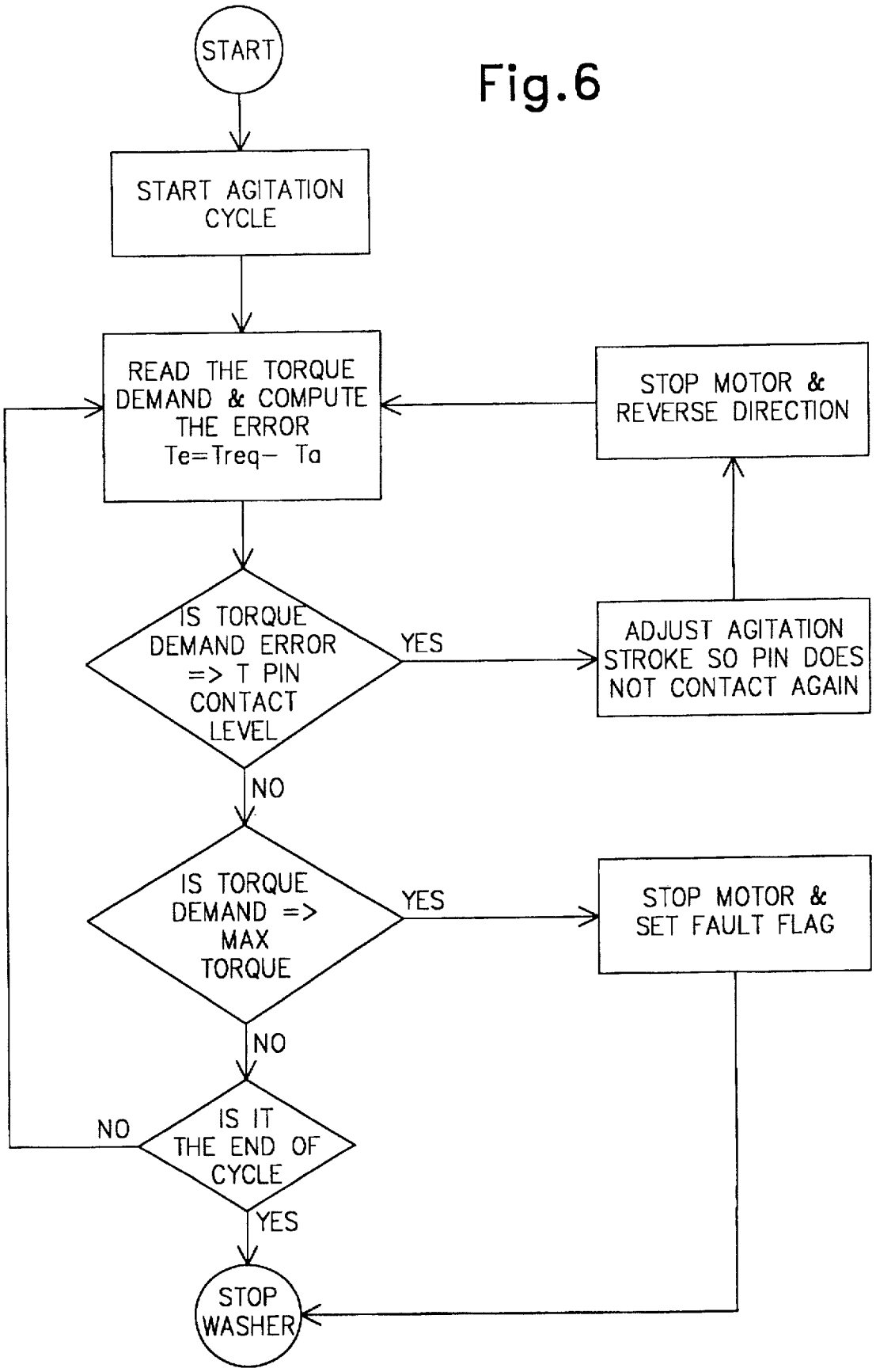
FIG. 6 is a flow diagram of a control algorithm for a sensing device of the discriminator mechanism of FIG. 3 using motor torque error level.

As best shown in FIG. 6, when the torque error level ($T_e$) of the motor 42 is used to detect contact, the motor controller 46 monitors the requested torque ($T_{req}$) and the actual Torque ($T_a$). The controller 46 calculates the torque error level ($T_e$) which is the difference between the requested torque ($T_{req}$) and the actual torque ($T_a$). The motor controller 46 sends the error level ($T_e$) to the washer controller 28. The washer controller 28 compares the error level ($T_e$) with a predetermined value (T Pin Contact Level) which indicates that contact of the drive pin 54 has occurred. When the washer controller 28 determines that the error level ($T_e$) is greater than the predetermined value, the washer controller 28 sends a signal to the motor controller 46 to adjust the oscillation arc of the agitator 36 so that the drive pin 54 does not contact the strike plate 92 on the next stroke and to reverse the direction of the motor 42.

Figure 7:
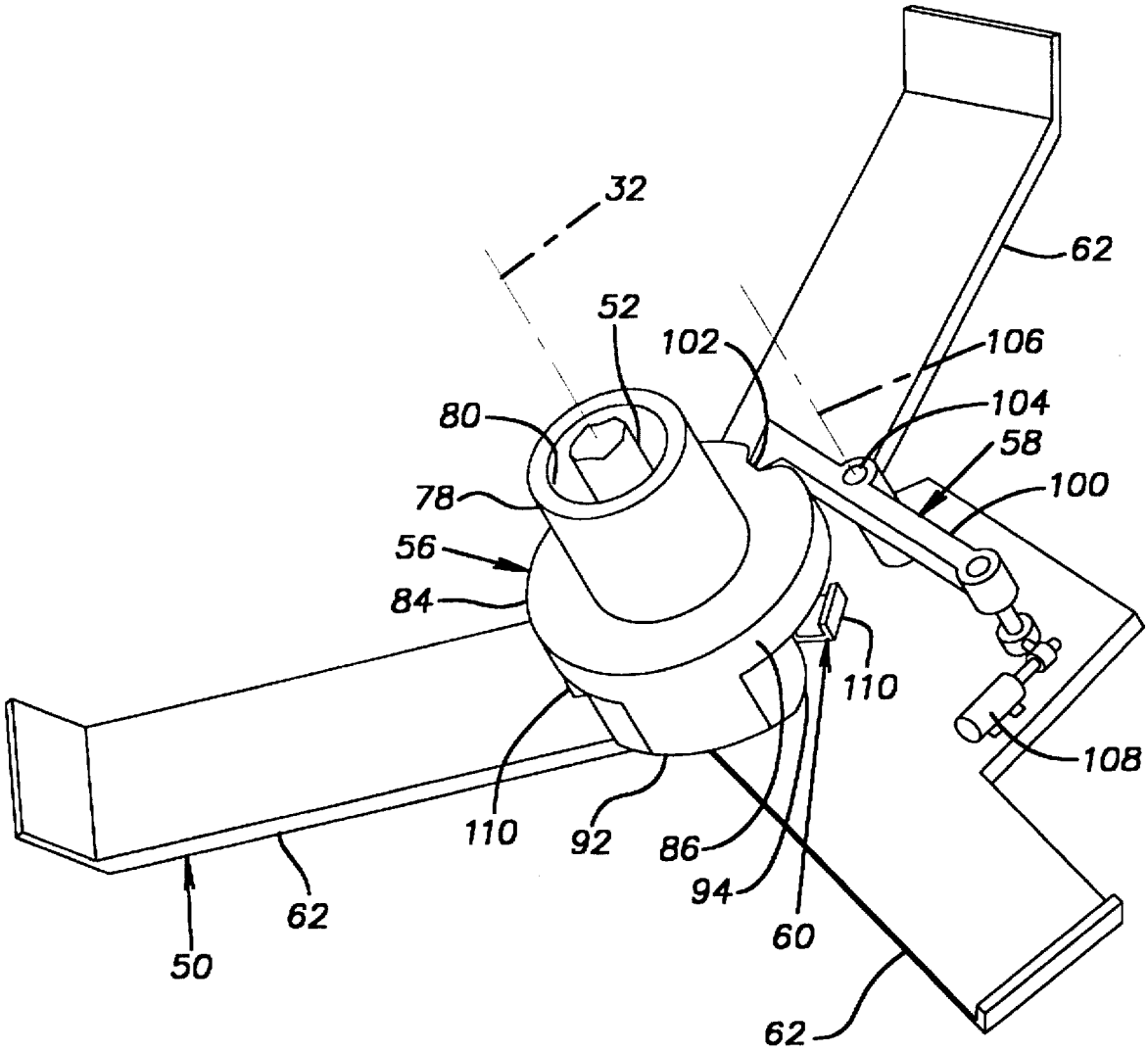
FIG. 7 is an enlarged top prospective view, similar to FIG. 3, of an alternative embodiment of a discriminator mechanism of the washing machine of FIG. 1.

FIG. 7 illustrates an alternative embodiment of the present invention wherein like reference numbers are used for like structure. The sensing device 60 includes a pair of sensors 110 which detect when the drive pin 54 is about to contact the strike plate 92. The sensors 110 are attached to the top surface of the mounting plate 50 adjacent the engagement surfaces 94 of the strike plate 92 so that the drive pin 52 passes the sensors 110 prior to contacting the strike plate 92. Mounted in this position the sensors 110 are at the extremes of the oscillation stroke of the agitator 36. The sensors 110 can be either hall effect transducers or photo interrupters.

Figure 8:
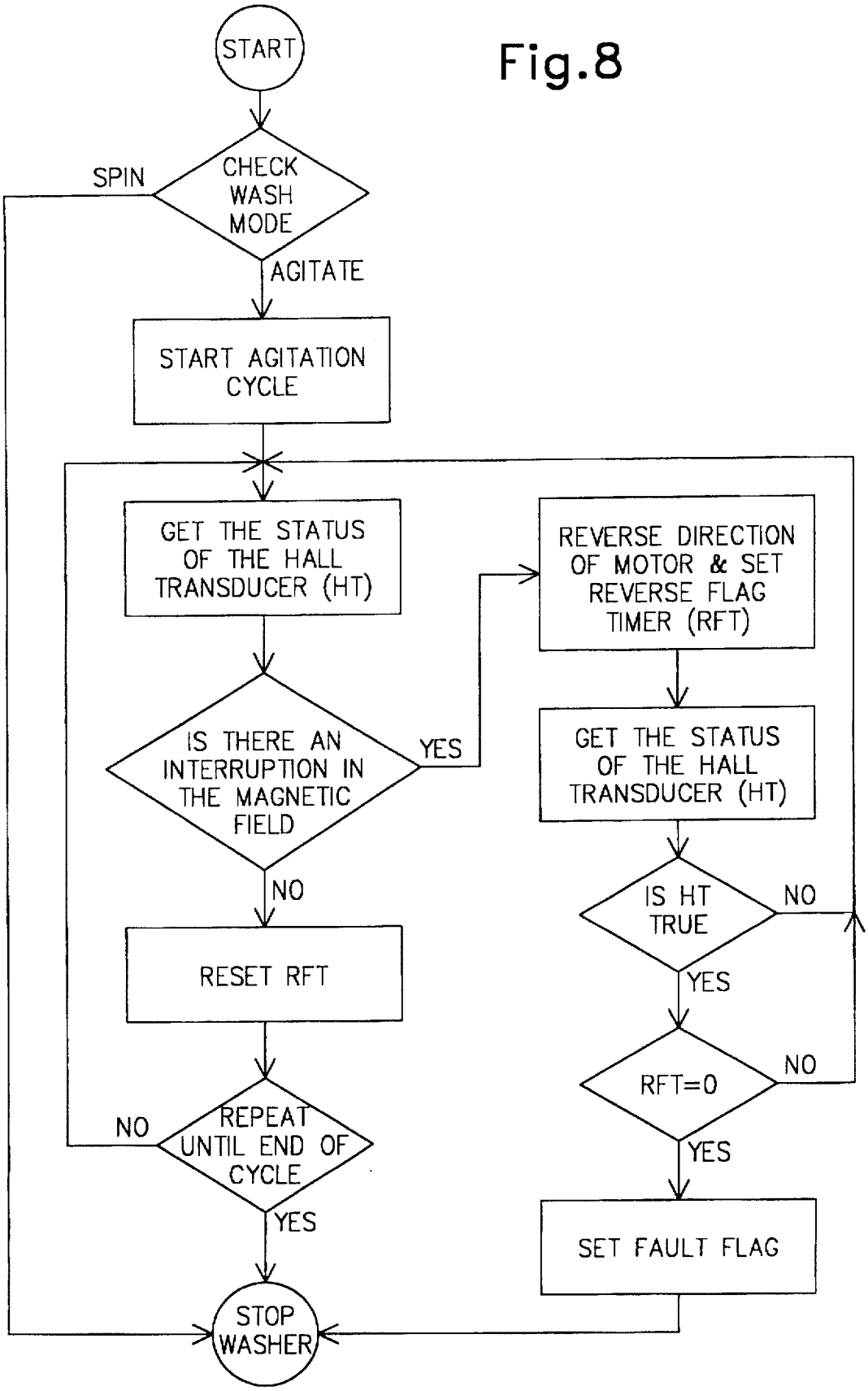
FIG. 8 is a flow diagram of a control algorithm for a sensing device of the discriminator mechanism of FIG. 7 using hall effect sensors.

As best shown in FIG. 8, when the sensors 110 are hall effect transducers, the washer controller 28 monitors an output signal of the sensors 110. When the washer controller 28 detects a change in the output signal of the sensors 110 indicating an interruption of the magnetic field due to the drive pin 54 passing through the magnetic field, the washer controller 28 sends a signal to reverse the direction of rotation of the motor 42. It is noted that the sensors 110 can alternatively be located anywhere along the oscillation stroke to provide a different stroke angle and additional sensors 110 can be added to provide multiple stroke angles.

Figure 9:
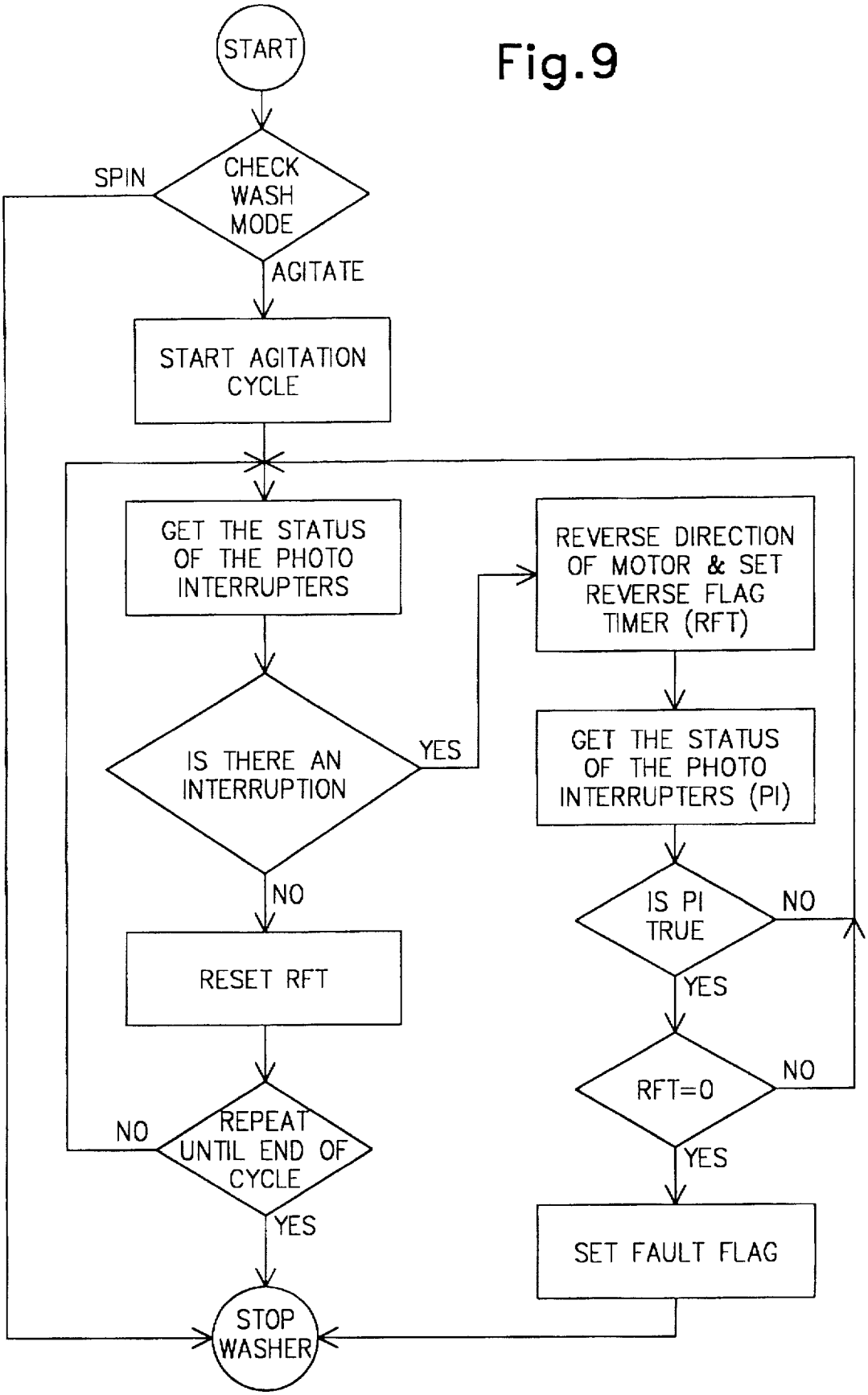
FIG. 9 is a flow diagram of a control algorithm for a sensing device of the discriminator mechanism of FIG. 7 using photo interrupters.

As best shown in FIG. 9, when the sensors 110 are photo interrupters, the washer controller 28 monitors an output signal of the sensors 110. When the washer controller 28 detects a change in the output signal of one of the sensors 110 indicating an interruption of the light beam due to the drive pin 54 passing between a light source and a photo detector, the washer controller 28 sends a signal to reverse the direction of rotation of the motor 42. It is noted that the sensors 110 can alternatively be anywhere along the oscillation stroke to provide a different stroke angle and additional sensors 110 can be added to provide multiple stroke angles.

Although particular embodiments of the invention have been described in detail, it will be understood that the invention is not limited correspondingly in scope, but includes all changes and modifications coming within the spirit and terms of the claims appended hereto.

What is claimed is:

1. A washing machine comprising:

a splash tub;

a spin tub located within said splash tub and rotatable about an axis of rotation;

an agitator located within said spin tub and rotatable about said axis of rotation; and a direct drive system adapted for spinning said spin tub about said axis of rotation during a spin cycle and oscillating said agitator about said axis of rotation during an agitation cycle, said drive system including an electric motor, a drive shaft having a first end connected to said motor and a second end connected to said agitator, a drive pin rigidly connected to said drive shaft, a drive hub encircling said drive shaft and rotatable relative to said drive shaft about said axis of rotation, wherein said drive hub is rigidly connected to said spin tub and has a strike plate adapted for engagement by said drive pin upon continuous rotation of said drive shaft about said axis of rotation to spin said spin tub about said axis of rotation and adapted for allowing oscillation of said drive pin upon oscillation of said drive shaft about said axis of rotation to oscillate said agitator, and a locking device for selectively preventing rotation of said drive hub during oscillation of said agitator.

2. A washing machine according to claim 1, wherein said locking device includes a locking fork pivotable about a pivot pin between a locking position wherein a first end of said locking fork engages a cooperating notch of the drive hub to prevent rotation of said drive hub about said axis of rotation and an unlocked position wherein said first end of said locking fork is out of engagement with said notch of the drive hub to allow rotation of said drive hub about said axis of rotation.

3. A washing machine according to claim 2, wherein said locking device includes an actuator connected to a second end of said locking fork to move said locking fork between said locking position and said unlocked position.

4. A washing machine according to claim 1, wherein said drive system includes a sensing device for detecting a location of the drive pin to avoid contact between said drive pin and said strike plate when said locking device is engaged.

5. A washing machine according to claim 4, wherein said sensing device includes a motor controller and a washer controller in electrical communication with said motor controller and adapted for detecting contact between said drive pin and said strike plate.

6. A washing machine according to claim 5, wherein said motor controller is adapted for detecting a current of said motor and said washer controller is adapted for comparing said current with a predetermined value indicating contact between said drive pin and said strike plate.

7. A washing machine according to claim 5, wherein said motor controller is adapted for determining a speed error level of said motor and said washer controller is adapted for comparing said speed error level with a predetermined value indicating contact between said drive pin and said strike plate.

8. A washing machine according to claim 5, wherein said motor controller is adapted for determining a torque error level of said motor and said washer controller is adapted for comparing said torque error level with a predetermined value indicating contact between said drive pin and said strike plate.

9. A washing machine according to claim 5, wherein said washer controller is adapted for adjusting a stroke angle of said drive pin when contact between said drive pin and said strike plate is detected to avoid contact during a subsequent stroke.

10. A washing machine according to claim 4, wherein said sensing device includes a pair of sensors positioned at opposite ends of the oscillation of said drive pin for detecting the drive pin passing thereby.

11. A washing machine according to claim 10, wherein said sensors are hall effect transducers.

12. A washing machine according to claim 10, wherein said sensors are photo detectors.

13. A washing machine according to claim 1, wherein said drive system includes a mounting plate attached to a bottom of said splash tub and supporting said motor.

14. A washing machine according to claim 13, wherein said mounting plate supports said drive shaft.

15. A washing machine according to claim 1, wherein said strike plate extends downwardly from a bottom surface of said drive plate and said drive pin rotates below said drive hub.

16. A washing machine according to claim 15, wherein said strike plate extends for about 150 degrees and forms a pair of opposed engagement surfaces.

17. A direct-drive washing machine comprising:

a splash tub;

a spin tub located within said splash tub and rotatable about an axis of rotation;

an agitator located within said spin tub and rotatable about said axis of rotation; and a direct drive system adapted for spinning said spin tub about said axis of rotation during a spin cycle and oscillating said agitator about said axis of rotation during an agitation cycle, said drive system including a mounting plate secured to said splash tub, an electric motor supported by said mounting plate, a drive shaft having a first end connected to said motor and a second end connected to said agitator, a drive hub encircling said drive shaft and rotatable relative to said drive shaft about said axis of rotation, said drive hub being rigidly connected to said spin tub and having a strike plate downwardly extending from a bottom surface of said drive hub, a drive pin rigidly connected to said drive shaft below said drive hub and adapted for engaging said strike plate upon continuous rotation of said drive shaft about said axis of rotation to spin said spin tub about said axis of rotation, said strike plate adapted for allowing oscillation of said drive pin upon oscillation of said drive shaft about said axis of rotation, a locking device attached to said mounting plate and adapted for selectively engaging said drive hub to prevent rotation of said drive hub during oscillation of said agitator, and a sensing device for detecting a location of the drive pin to avoid contact between said drive pin and said strike plate when said locking device is engaging said drive hub.

18. A method of operating a direct-drive washing machine comprising the steps of:

oscillating an agitator located within a spin tub about an axis of rotation during an agitation cycle by oscillating an electric motor connected to the agitator by a drive shaft;

spinning the spin tub located within a splash tub about the axis of rotation during a spin cycle by continuously rotating the electric motor and contacting a strike plate of a drive hub encircling the drive shaft and rigidly connected to the spin tub with a drive pin rigidly connected to the drive shaft; and locking the spin tub against rotation with a locking device when oscillating the agitator.

19. A method according to claim 18, further comprising the step of detecting a location of the drive pin with a sensing device to avoid contact between the drive pin and the strike plate when the locking device is engaged.

20. A method according to claim 19, further comprising the step of adjusting the oscillation stroke angle of the drive pin when contact is detected by the sensing device to prevent contact on the next oscillation stroke.

21. A method according to claim 19, wherein the step of detecting the location of the drive pin includes monitoring a current of the motor with a motor controller and comparing the current with washer controller to a predetermined value indicating contact between the drive pin and the strike plate.

22. A method according to claim 19, wherein said step of detecting the location of the drive pin includes determining a speed error level of the motor with a motor controller and comparing the speed error level with a washer controller to a predetermined value indicating contact between the drive pin and the strike plate.

23. A method according to claim 19, wherein said step of detecting the location of the drive pin includes determining a torque error level of the motor with a motor controller and comparing the torque error level with a washer controller to a predetermined value indicating contact between the drive pin and the strike plate.

24. A method according to claim 19, wherein said step of detecting the location of the drive pin includes sensing the drive pin passing by sensors positioned at opposite ends of the oscillation of the drive pin.

25. A method according to claim 24, wherein said sensors are hall effect transducers.

26. A method according to claim 24, wherein said sensors are photo detectors.

* * * * *